US009803368B1

(12) United States Patent
Stehl

(10) Patent No.: US 9,803,368 B1
(45) Date of Patent: Oct. 31, 2017

(54) METHODS AND SYSTEMS OF PREPARING AND INSTALLING CUSTOM-MADE SPIRAL STAIRCASES

(71) Applicant: Paul David Stehl, Phoenix, AZ (US)

(72) Inventor: Paul David Stehl, Phoenix, AZ (US)

( * ) Notice: Subject to any disclaimer, the term of this patent is extended or adjusted under 35 U.S.C. 154(b) by 0 days.

(21) Appl. No.: 15/130,638

(22) Filed: Apr. 15, 2016

(51) Int. Cl.
*E04F 11/02* (2006.01)
*E04F 11/032* (2006.01)
*E04F 11/18* (2006.01)
*E04F 11/104* (2006.01)

(52) U.S. Cl.
CPC ..... *E04F 11/032* (2013.01); *E04F 11/104* (2013.01); *E04F 11/1836* (2013.01); *E04F 11/1842* (2013.01)

(58) Field of Classification Search
CPC ... E04F 11/032; E04F 11/104; E04F 11/1834; E04F 11/025; E04F 11/1043
See application file for complete search history.

(56) References Cited

U.S. PATENT DOCUMENTS 1,726,133 A * 8/1929 Wilson ..... E04F 11/032 52/187
3,491,498 A 1/1970 Hughes, Jr.
3,740,906 A 6/1973 Schnelder
4,128,976 A * 12/1978 Classen ..... E04F 11/032 52/187
4,338,751 A 7/1982 Sanders
4,413,460 A 11/1983 Gerlach
4,527,367 A * 7/1985 Morellini ..... E04F 11/032 52/187
4,850,164 A 7/1989 McLeod
4,869,034 A 9/1989 Hammond
6,044,599 A * 4/2000 Wachenfeld ..... E04F 11/032 403/299
6,108,988 A * 8/2000 Nagelski ..... A63B 9/00 182/48
8,281,525 B2 10/2012 Driscoll
2009/0094907 A1* 4/2009 Denicolo ..... E04F 11/1043 52/188

FOREIGN PATENT DOCUMENTS

KR 1020140087588A A 7/2014
WO WO2005071182 8/2005

* cited by examiner

*Primary Examiner* — Gisele Ford
(74) *Attorney, Agent, or Firm* — Booth Udall Fuller, PLC

(57) ABSTRACT

Described herein are systems and methods of manufacturing a spiral staircase assembly for custom projects. A method may include coupling a plurality of stairs to a center column such that distances between adjacent stairs of the plurality of stairs deviates less than ½" to meet code. A method may further include cutting the center column after coupling the plurality of stairs to the center column to form a first center column and a second center column. A method may further include welding a female column coupling to a first end of the first center column and welding a male column coupling to a first end of the second center column. The male column coupling is configured to couple to the female column coupling such that when the male column coupling is coupled to the female column coupling, distances between adjacent stairs of the plurality of stairs deviates less than ½".

14 Claims, 13 Drawing Sheets

METHODS AND SYSTEMS OF PREPARING AND INSTALLING CUSTOM-MADE SPIRAL STAIRCASES

BACKGROUND

1. Technical Field

Aspects of this document relate generally to spiral staircase assemblies.

2. Background Art

Spiral staircases are a regular features in homes and business. To meet national and/or local building codes, stairs on a spiral staircase assembly typically may not vary in distance from adjacent steps more than ½" or even ⅜". Because the specific distance between the top and the bottom of the staircase varies with each project, conventional staircase assemblies are either assembled entirely at the place of manufacture shipped as completely assembled spiral staircase, or entirely assembled from scratch (including welding) at the installation site. Each of these approaches presents its own difficulties in manufacture and installation of spiral staircases that conform to local building codes.

SUMMARY

In one aspect, a method of manufacturing a spiral staircase assembly may comprise affixing a plurality of stairs to a center column, the plurality of stairs comprising, among others, a first stair and a second stair adjacent to the first stair, cutting the center column between the first stair and the second stair after affixing the plurality of stairs to the center column, wherein cutting the center column divides the center column into a first center column and a second center column, and welding a male column coupling to a first end of the second center column after cutting the center column that has the second stair affixed, the male column coupling sized and shaped to mate with a first end of the first center column such that when the male column coupling is mated with the first end of the first center column coupling each stair of the plurality of stairs has at least one distance between a top surface of the stair and a top surface of at least one adjacent stair, the distances between the top surface of each stair and the top surface of each adjacent stair is within a ½" deviation of all other distances between the top surfaces of the adjacent stairs.

Particular embodiments may comprise one or more of the following features. After cutting the center column that has the stair affixed, inserting a base of the female column coupling into the first end of the first center column until a column lip of the female column coupling abuts the first end of the first center column before welding the female column coupling to the first end of the first center column such that a body of the female column coupling is positioned outside the first center column, and inserting a base of the male column coupling into the first end of the second center column until a column lip of the male column coupling abuts the first end of the second center column before welding the male column coupling to the first end of the second center column such that a body of the male column coupling is positioned outside the second center column. Cutting a portion from the center column to form the first center column and the second center column, the portion cut from the center column comprising a height substantially equal to a combined height of the body of the female column coupling mated with the body of the male column coupling. Coupling the female column coupling to the male column coupling after welding the female column coupling to the first center column and welding the male column coupling to the second center column. Inserting a head of the male column coupling distal the base of the male column coupling into a receiver of the female column coupling distal the base of the female column coupling, and inserting at least one fastener through a hole in the female column coupling aligned with a hole in the head of the male column coupling. Coupling a plurality of balusters to the plurality of stairs before cutting the center column, coupling a handrail to the plurality of balusters distal the plurality of stairs before cutting the center column, cutting the handrail between the two adjacent stairs of the plurality of stairs to form a first handrail and a second handrail, and welding a female handrail coupling to a first end of the first handrail, welding a male handrail coupling to a first end of the second handrail, the male handrail coupling configured to couple to the female handrail coupling. Coupling the female handrail coupling to the male handrail coupling and coupling the female handrail coupling to the male handrail coupling.

According to another aspect, a method of manufacturing a custom spiral staircase assembly may comprise determining a custom spiral staircase height at an installation site for a spiral staircase assembly, determining a number of individual stairs of a plurality of stairs to position within the custom height of the spiral staircase assembly, determining a distance between top surfaces of adjacent stairs of the plurality of stairs such that each stair of the plurality of stairs has at least one distance between the top surface of the stair and the top surface of at least one adjacent stair and the distances between the top surface of each stair and the top surface of each adjacent stair is within a ½" deviation of all other distances between the top surfaces of adjacent stairs, affixing the plurality of stairs to a center column, the plurality of stairs comprising, among others, a first stair and a second stair adjacent to the first stair, and cutting the center column between the first stair and the second stair after affixing the plurality of stairs to the center column to form a first center column including the first stair affixed thereto, and a second center column including the second stair affixed thereto.

Particular embodiments may comprise one or more of the following features. Inserting a base of a female column coupling into the first end of the first center column until a column lip of the female column coupling abuts the first end of the first center column and a body of the female column coupling is positioned outside the first center column, welding the female column coupling to a first end of the first center column, inserting a base of a male column coupling into the first end of the second center column until a column lip of the male column coupling abuts the first end of the second center column and a body of the male column coupling is positioned outside the second center column, and welding the male column coupling to a first end of the second center column, the male column coupling configured to couple to the female column coupling such that when the male column coupling is coupled to the female column coupling, the distances between each stair and each adjacent stair is within a ½" deviation of all other distances between adjacent stairs. Transporting the first center column, with the first plurality of stairs coupled to the first center column, and the second center column, with the second plurality of stairs coupled to the second center column, to the installation site, and coupling the first center column to the second center column at the installation site. Inserting a head of the male column coupling distal the base of the male column coupling into a receiver of the female column coupling distal the base of the female column coupling, and inserting at least one fastener through a hole in the female column coupling aligned with a hole in the head of the male column coupling to couple the female column coupling to the male coupling. Coupling a plurality of a balusters to the plurality of stairs before cutting the center column, coupling a handrail to the plurality of balusters distal the plurality of stairs before cutting the center column, and cutting the handrail between the two adjacent stairs of the plurality of stairs to form a first handrail and a second handrail. Welding a female handrail coupling to a first end of the first handrail, and welding a male handrail coupling to a first end of the second handrail, the male handrail coupling configured to couple to the female handrail coupling. Inserting a head of the male handrail coupling distal a base of the male handrail coupling into a receiver of the female handrail coupling distal a base of the female handrail coupling, and inserting at least one fastener through a hole in the female handrail coupling aligned with a hole in the head of the male handrail coupling to couple the female handrail coupling to the male handrail coupling.

According to another aspect, a spiral staircase assembly may comprise a first center column comprising a first plurality of stairs affixed to and extending outward from the first center column, a female column coupling welded to a first end of the first center column, the female column coupling comprising a base positioned within the first center column, a body positioned outside the column, a column lip abutting a first end of the first center column and positioned between the base and the body, a coupling end opposite the base, a receiver extending into the coupling end, and one or more holes extending through the body to the receiver, a male column coupling coupled to the female coupling opposite the first center column, the male column coupling comprising a head positioned within the receiver of the female column coupling, a body, a coupling lip abutting the coupling end of the female column coupling and positioned between the head and the body, a base opposite the head, a column lip positioned between the base and the body of the male coupling, and one or more holes extending into the head of the male coupling, one or more fasteners, each one of the one or more fasteners extending through a different one of the one or more holes of the female column coupling and into a different one of the one or more holes of the male column coupling, a second center column welded to the male coupling opposite the female column coupling with the base of the male column coupling positioned within a first end of the second center column, the second center column comprising a second plurality of stairs affixed to and extending outward from the second center column, and wherein the first center column, first plurality of stairs, female column coupling, male column coupling, second plurality of stairs and one or more fasteners form a spiral staircase and each stair of a combination of the first plurality of stairs and the second plurality of stairs has at least one distance between a top surface of the stair and a top surface of at least one adjacent stair, the distances between the top surface of each stair and the top surface of each adjacent stair is within a ½" deviation of all other distances between the top surfaces of adjacent stairs.

Particular embodiments may comprise one or more of the following features. An outer surface of the first center column, an outer surface of the body of the female column coupling, and outer surface of the male column coupling, and an outer surface of the second center column may be substantially flush with one another. The head of the male column coupling may interface with the receiver of the female column coupling. A plurality of balusters, each one of the plurality of balusters coupled to one stair of the plurality of stairs of the first center column or the second center column, and a handrail coupled to the plurality of balusters distal the plurality of stairs. A first handrail coupled to a plurality of balusters coupled to the plurality of stairs of the first center column, a female handrail coupling welded to the first handrail, the female handrail coupling comprising a base positioned within the first center column, a body positioned outside the column, a coupling end opposite the base, a receiver extending into the coupling end, and one or more holes extending through the body to the receiver, a male handrail coupling coupled to the female handrail coupling opposite the first center column, the male handrail coupling comprising a head positioned within the receiver of the female handrail coupling, a body, a coupling lip abutting the coupling end of the female handrail coupling and positioned between the head and the body, a base opposite the head, a column lip positioned between the base and the body of the male handrail coupling, and one or more holes extending into the head of the male handrail coupling, one or more fasteners, each one of the one or more fasteners extending through a different one of the one or more holes of the female handrail coupling and into a different one of the one or more holes of the male handrail coupling, and a second handrail welded to the male handrail coupling opposite the female handrail coupling with the base of the male handrail coupling positioned within the second handrail, the second handrail coupled to a plurality of balusters coupled to the plurality of stairs of the second center column.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

Figure 1:
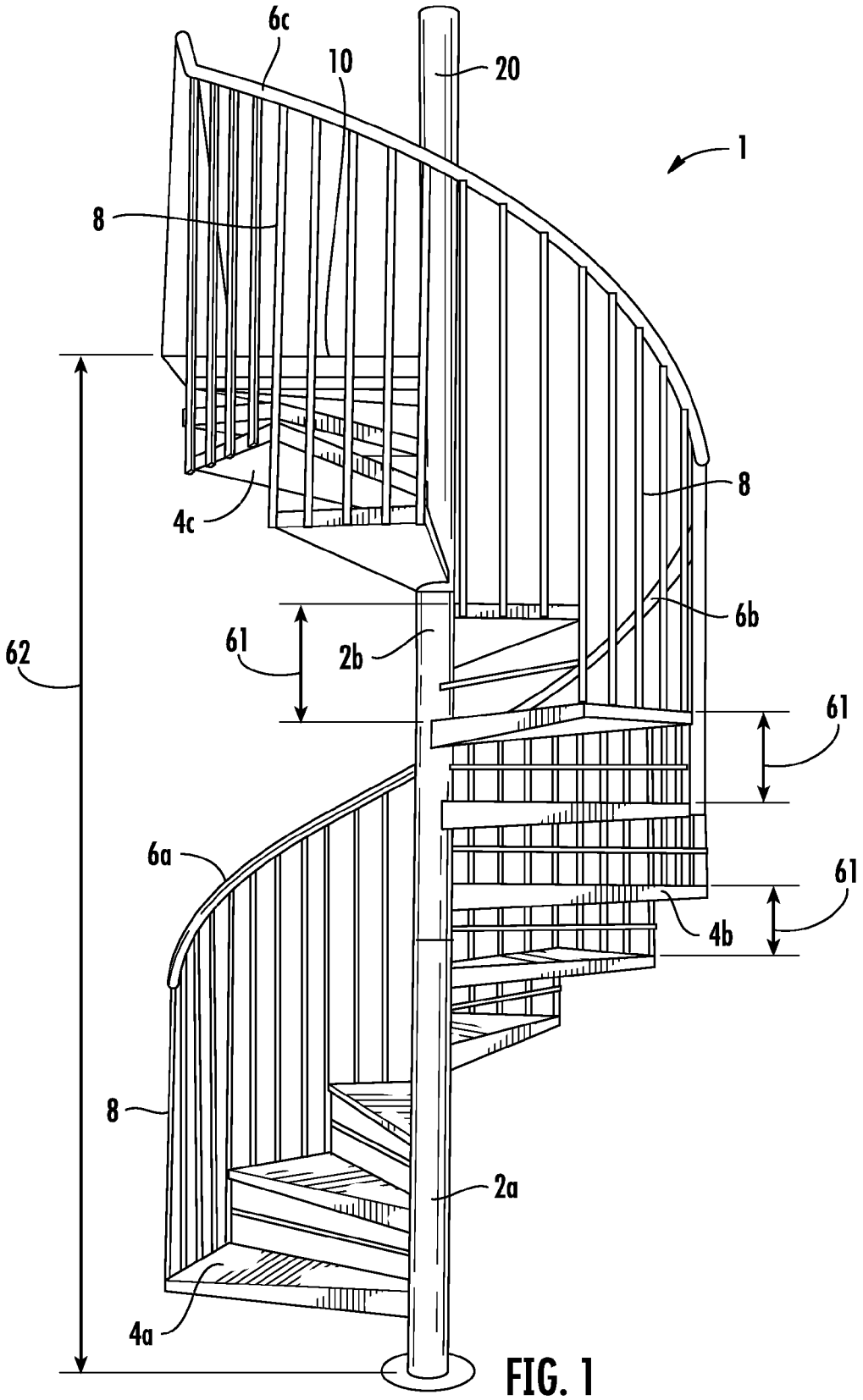
FIG. 1 is side view of an assembled spiral staircase assembly.

This disclosure, its aspects and implementations, are not limited to the specific components or assembly procedures disclosed herein. Many additional components and assembly procedures known in the art consistent with the intended spiral staircase assembly and/or assembly procedures for a spiral staircase assembly will become apparent for use with implementations of spiral staircase assemblies from this disclosure. Accordingly, for example, although particular spiral staircase assemblies are disclosed, such spiral staircase assemblies and implementing components may comprise any shape, size, style, type, model, version, measurement, concentration, material, quantity, and/or the like as is known in the art for such spiral staircase assemblies and implementing components, consistent with the intended operation of a spiral staircase assembly.

Spiral staircases are routinely used in various home and commercial settings. National and local building codes generally require a substantially uniform distance between stairs on a staircase. For example, a national or local building code may require less than ½" or ⅜" deviation in the distances between adjacent steps on the staircase. Because each project or installation site likely varies in height dimension, in order to meet these codes, conventional staircase assemblies typically prevent bulk manufacture of spiral staircase assemblies. Instead, conventional spiral staircase assemblies typically include affixing the stairs to the center column at the installation site. This process is cumbersome, especially when welding is required at the installation site to affix the stairs to the center column. Stairs are typically affixed to the center column with welding or with bolts and brackets to permanently affix them to the center column and provide the necessary secure attachment to the center column. Various systems and methods contemplated as part of this disclosure improve upon conventional systems and methods of assembling a spiral staircase assembly by providing an assembly system and method wherein a majority of the assembly takes place at the place of manufacture and only simple, quick work takes place at the installation site. As shall be shown in greater detail below, various embodiments contemplated as part of this disclosure include determining the specific height needed for a spiral staircase assembly at an installation site and building a code-compliant spiral staircase assembly to meet all relevant local and national codes. After the spiral staircase assembly is completely constructed and fully welded to meet code, one or more strategic locations are chosen to cut the staircase assembly into smaller, more manageable sections for ease of shipping and erecting. Column couplings may then be welded or otherwise coupled to the two or more pieces of the center column. The two or more pieces of center column, each with some of the plurality of stairs affixed thereto, may then be transported to the installation site. Once at the installation site, the two or more pieces of the center column may then be reassembled with the column couplings and without welding at the installation site. This allows for the creation of a spiral staircase assembly at the installation site that meets code, without the use of welding at the installation site.

Figure 2:
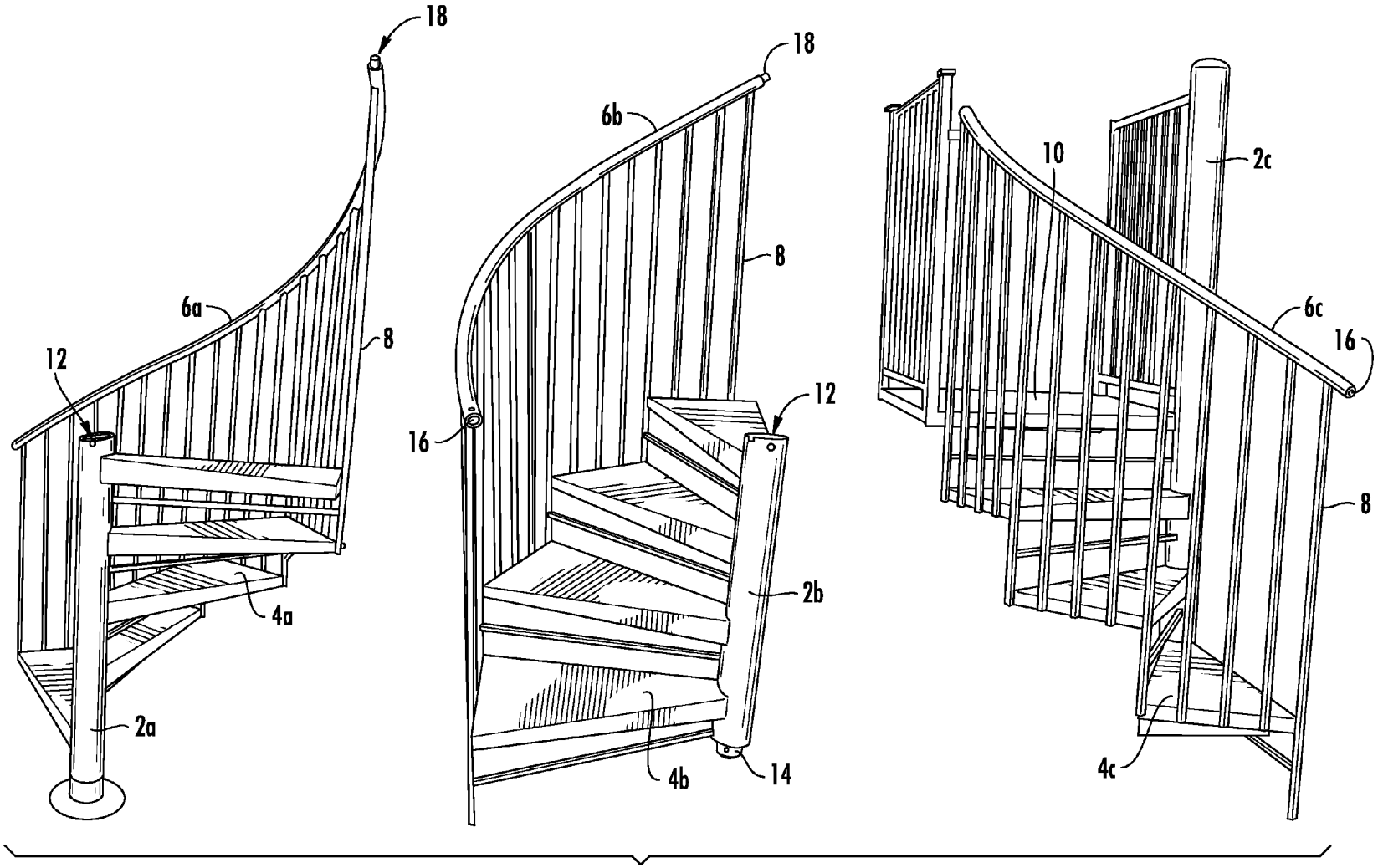
FIG. 2 is a side view of a disassembled spiral staircase assembly.

FIG. 2 depicts a non-limiting embodiment of a spiral staircase assembly 1 in three separate pieces after initial assembly and cutting, while FIG. 1 depicts the non-limiting embodiment of the spiral staircase assembly 1 of this disclosure after initial assembly, cutting, and reassembly. In one or more embodiments, a spiral staircase assembly 1 comprises two or more center columns 2*a*, 2*b*, 2*c* formed from a single center column 2 (as shall be described in greater detail below). Each center column 4*a*, 4*b*, 4*c* may comprise a plurality of stairs 4*a*, 4*b*, and 4*c* coupled to the respective center column 4*a*, 4*b*, and 4*c*. According to some aspects, each stair of the plurality of stairs 4*a*, 4*b*, 4*c* deviate less than ½", more particularly less than ⅜" in distance 61 from an adjacent stair of the plurality of stairs 4*a*, 4*b*, 4*c* center columns 2*a*, 2*b*, 2*c*. In some embodiments, a top platform 10 may also be welded or otherwise coupled to the third (or top) center column 2*c*. According to some aspects, determining a custom height described in the methods below is determined by determining a distance between the top platform 10 and the floor or ground beneath the top platform 10.

One or more embodiments of a staircase assembly 1 comprise a first center column 2*a* coupled to a second center column 2*b*. While reference is made below to coupling of the first center column 2*a* to the second center column 2*b*, it will be understood that the second center column 2*b* may be similarly coupled to a third center column 2*c*, a third center column 2*c* may be similarly coupled to a fourth center column, and so on. In some embodiments the first center column 2*a* and the second center column 2*b* are removably coupled together with a female column coupling 12 coupled directly to the first center column 2*a* and a male column coupling 14 directly coupled to the second center column 2*b*. It will be understood that the female column coupling 12 and the male column coupling may be switched with one another without departing from the scope of this disclosure. FIG. 2 shows a non-limiting embodiment of a disassembled staircase assembly 1 with a first center column 2*a* comprising a female column coupling 12 coupled thereto, a second center column 2*b* comprising a male column coupling 14 configured and positioned to couple to the female column coupling 12 of the first center column and a female column coupling 12 coupled to the second center column 2*b* distal the male column coupling 14 coupled thereto, and a third center column 2*c* comprising male column coupling 14 (not visible) configured and positioned to couple to the female column coupling 12 of the second center column 2*a*.

According to some aspects, a male column coupling 14 and/or a female column coupling 12 may be fixedly couple to a respective center column 2*a*, 2*b*, 2*c* with welding 20. For example, in the non-limiting embodiment shown in FIG. 3A, the male column coupling 14 is coupled to a first end 3*b* of the second center column 2*b* with welding 20, and the female column coupling 12 is coupled to a first end 3*a* of the first center column 2*a* with welding 20. In other embodiments, the male column coupling 14 and female column coupling 12 may be fixedly or removably coupled to the respective center columns with any fastener, adhesive, and the like known in the art.

Figure 3A:
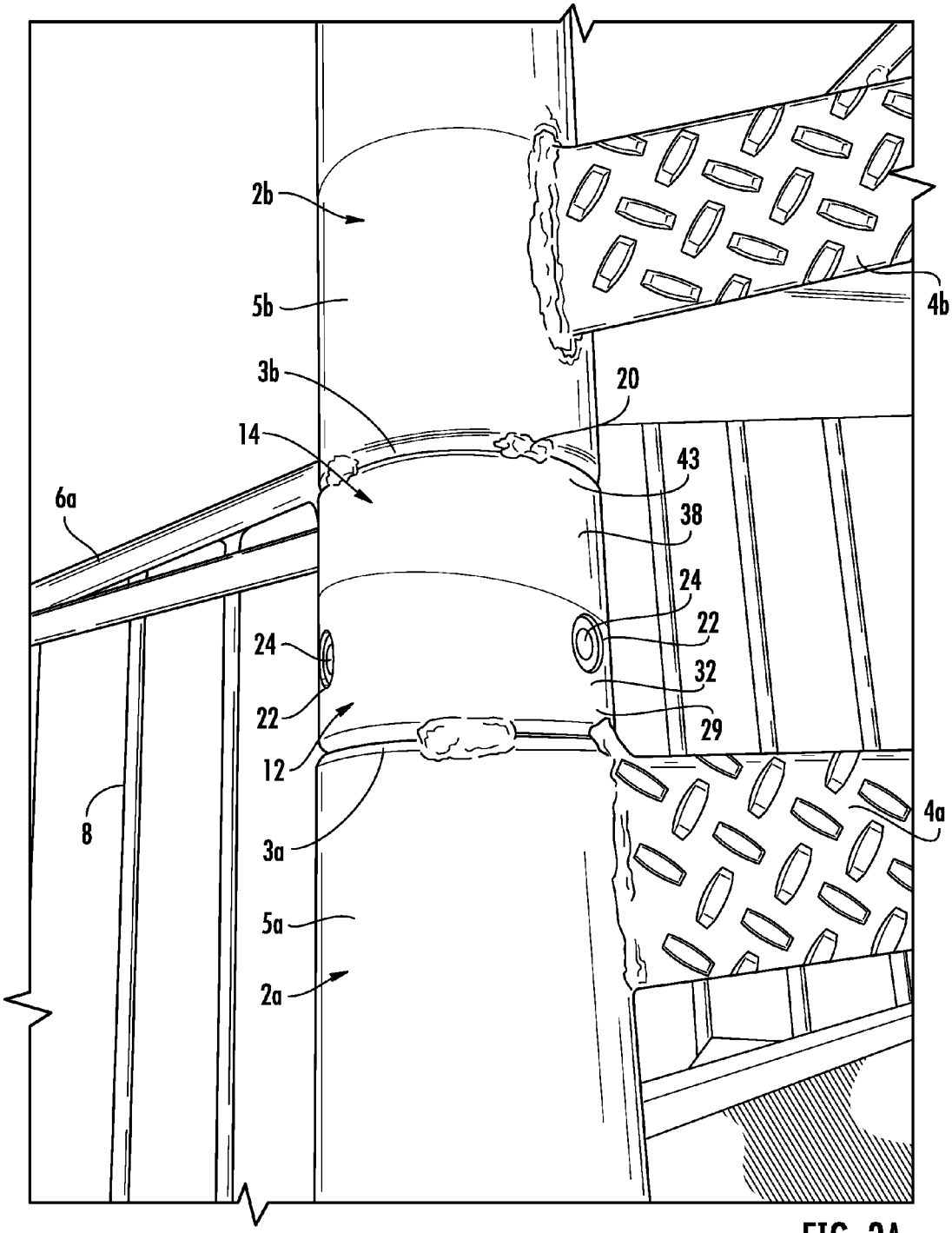
FIG. 3A is a close up view of a male column coupling and a female column coupling a first center column and a second center column of a spiral staircase assembly.
Figure 4A:
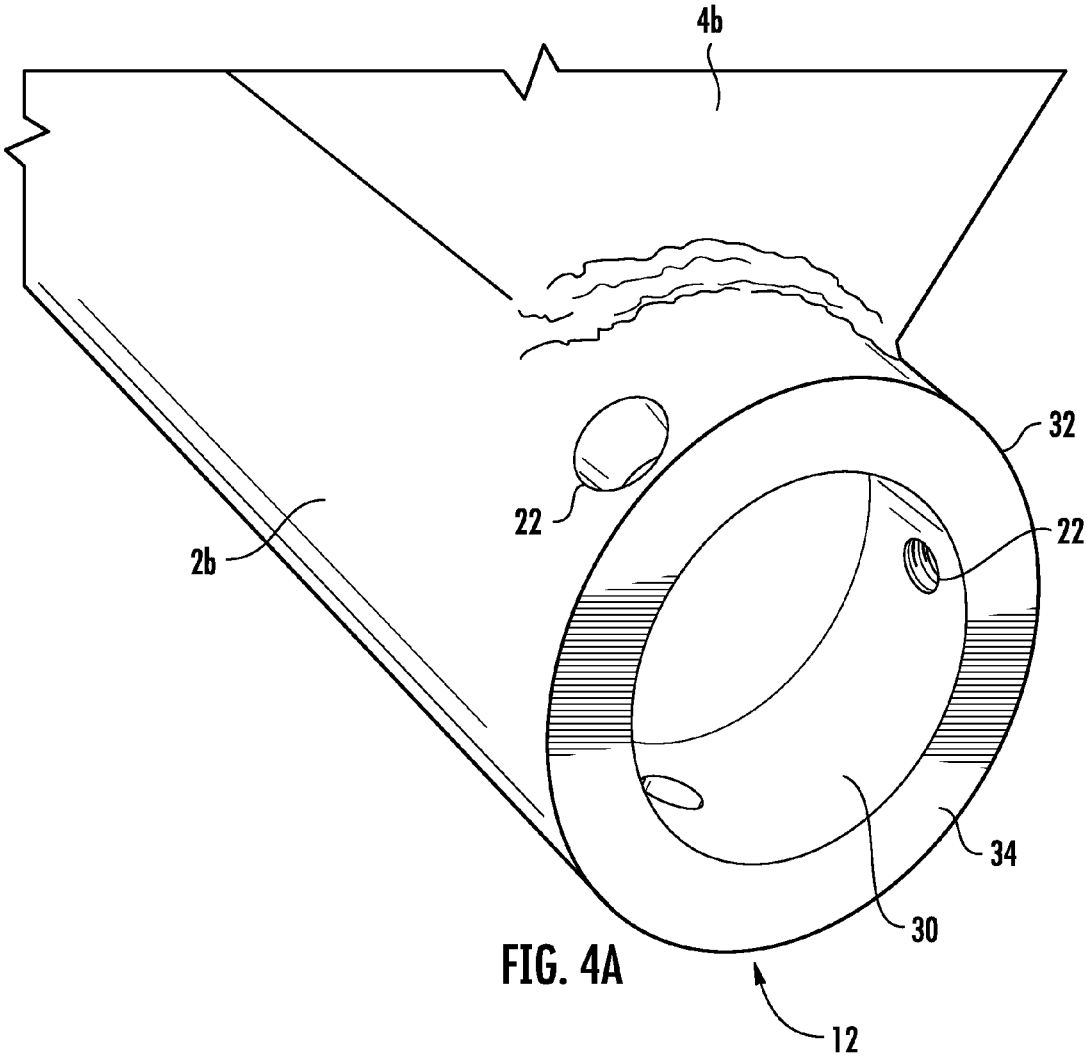
FIG. 4A is a close up view of a female column coupling coupled to a center column.
Figure 6A:
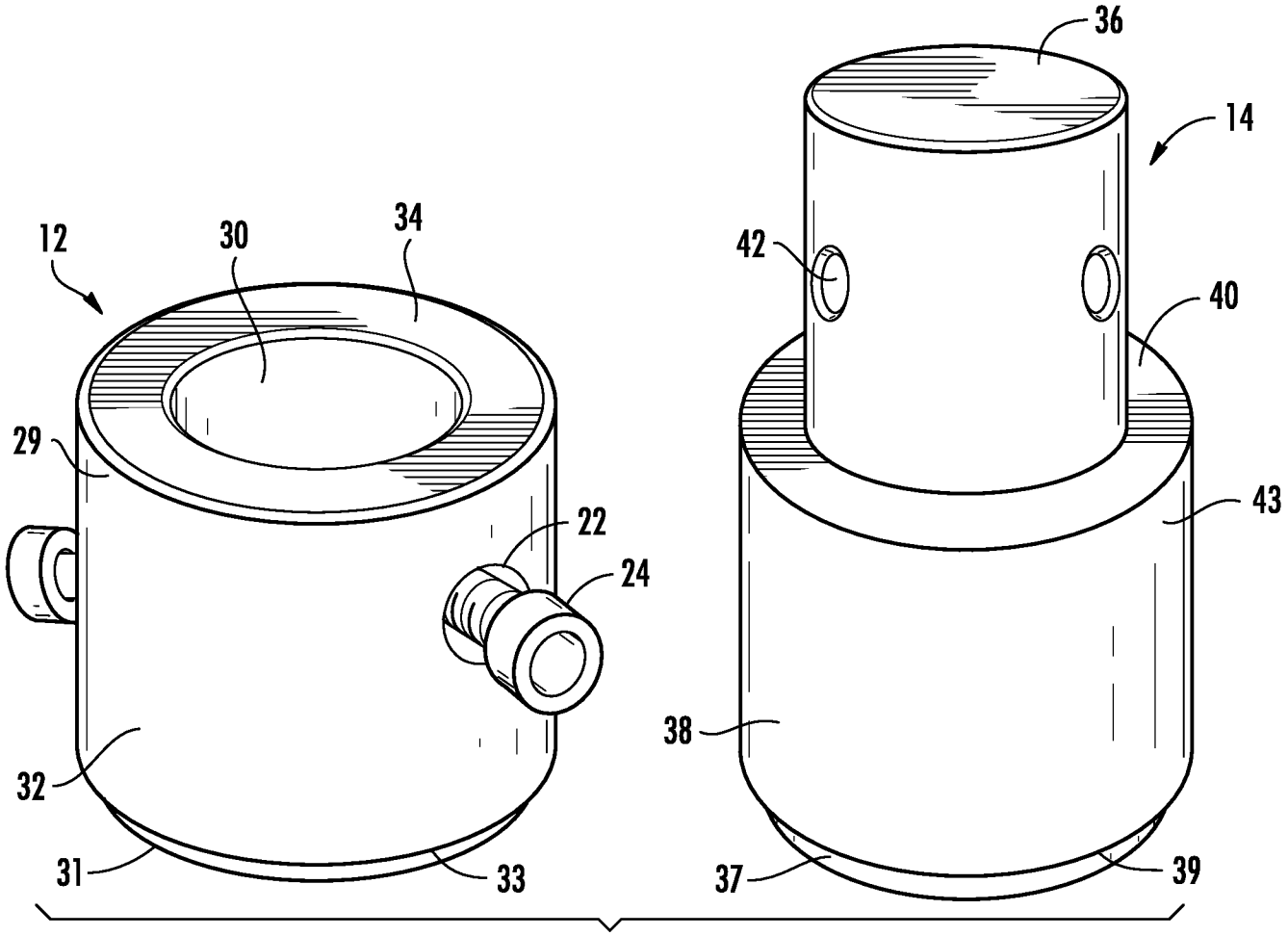
FIG. 6A is a side perspective view of an uncoupled female column coupling and male column coupling.

Reference is made herein to a female column coupling 12. A female column coupling 12 according to various embodiments may comprise any female coupling known in the art and configured to couple to a center column and removably couple to a male coupling. FIG. 4A shows a non-limiting embodiment of a female column coupling 12 fixedly coupled to a second center column 2*b* and FIG. 6A shows a non-limiting embodiment of a female column coupling 12 separated from a male column coupling 14. In one or more embodiments, a female column coupling 14 comprises a base 31 positioned within the first center column 2*a* (or second center column 2*b*, third center column 2*c*, etc.), a body 32 positioned outside the second center column 2*b*, a column lip 33 abutting a first end 3*a* of the first center column 2*a* (shown in FIG. 3A) and positioned between the base 31 and the body 32, a coupling end 34 opposite the base 31, a receiver 30 extending into the coupling end 34 and sized to receive the head 36 of the male column coupling 14, and one or more holes 22 extending through the body 32 to the receiver 30. In one or more embodiments, the body 32 may be sized such that the outer surface 29 of the body 32 is substantially flush with the outer surface 5*a* of the first center column, the outer surface 43 of the male column coupling 14, and the outer surface 5*b* of the second center column 2*b* (see, for example, FIGS. 4C and 6B). In some embodiments, the receiver 30 may be sized to interface with the head 36 of the male column coupling 14 when the female column coupling 12 and the male column coupling 14 are coupled to one another.

Reference is made herein to a male column coupling 14. A male column coupling 12 according to various embodiments may comprise any male coupling known in the art and configured to couple to a center column and removably coupled to a female coupling. In particular embodiments, the male coupling may be inserted directly into the open end of the second center column (2*b*, 4*b*) to provide the connection and structural reinforcement. In other embodiments, a specific female coupling with additional reinforcement may be used.

Figure 4B:
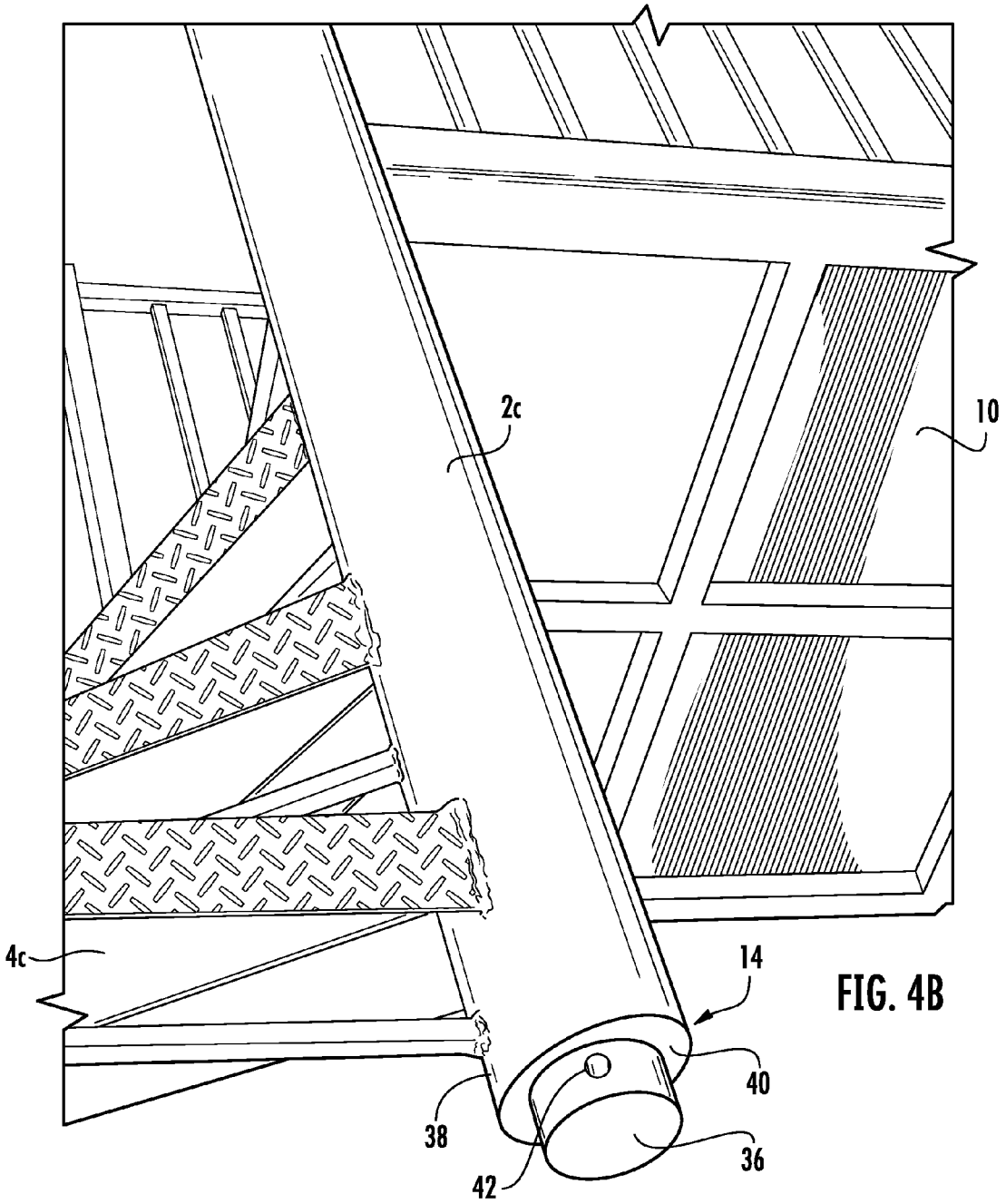
FIG. 4B is a close up view of a male column coupling coupled to a center column.

FIG. 4B shows a non-liming embodiment of a male column coupling 14 fixedly coupled to a first center column 2*b* and FIG. 6A shows a non-limiting embodiment of a male column coupling 14 separated from a female column coupling 12. In one or more embodiments, a male column coupling 12 comprises a base 37 positioned within the second center column 2*b* (or first center column 2*a*, third center column 2*c*, etc.), a body 38 positioned outside the second center column 2*b*, a column lip 39 abutting a first end 3*b* of the second center column 2*b* (shown in FIG. 3A) and positioned between the base 37 and the body 38, a head 36 positioned within the receiver 30 of the female column coupling 12, a coupling lip 40 positioned between the head 36 and the body 38 and abutting the coupling end 34 of the female column coupling 12, and one or more holes 42 extending into the head 36. The one or more holes 42 extended into the head 36 of the male column coupling 14 are positioned to align with the one or more holes 22 extending through the body 32 of the female column coupling 12. In one or more embodiments, the body 38 may be sized such that the outer surface 42 of the body 38 is substantially flush with the outer surface 5*a* of the first center column, the outer surface 29 of the female column coupling 12, and the outer surface 5*b* of the second center column 2*b* (see, for example, FIGS. 4C and 6B). In some embodiments, the head 36 may be sized to interface with the receiver 30 of the female column coupling 12 when the female column coupling 12 and the male column coupling 14 are coupled to one another.

Figure 4C:
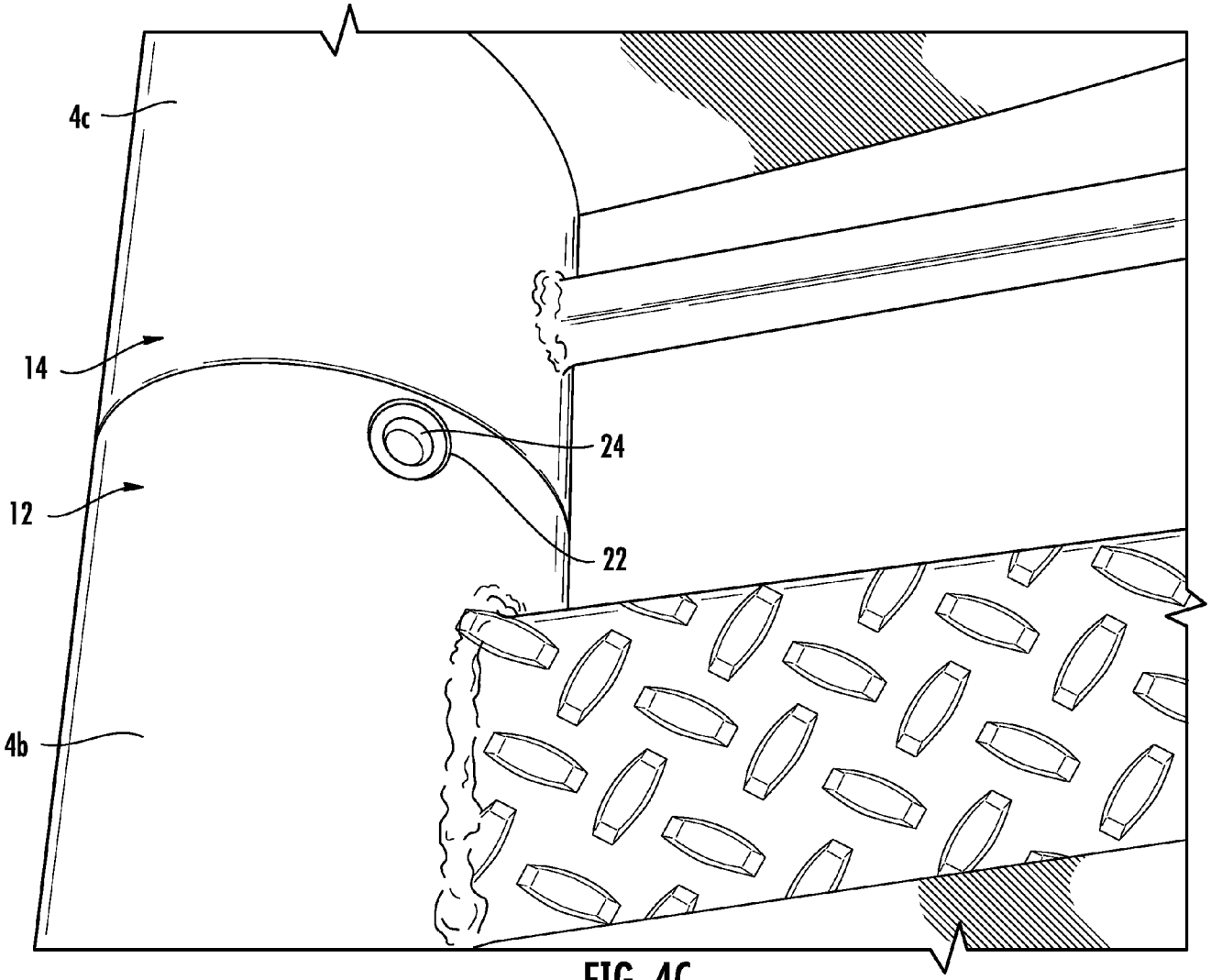
FIG. 4C is a close up view of a reassembled spiral staircase assembly with a male column coupling and a female column coupling a first center column and a second center column of a spiral staircase assembly.
Figure 6B:
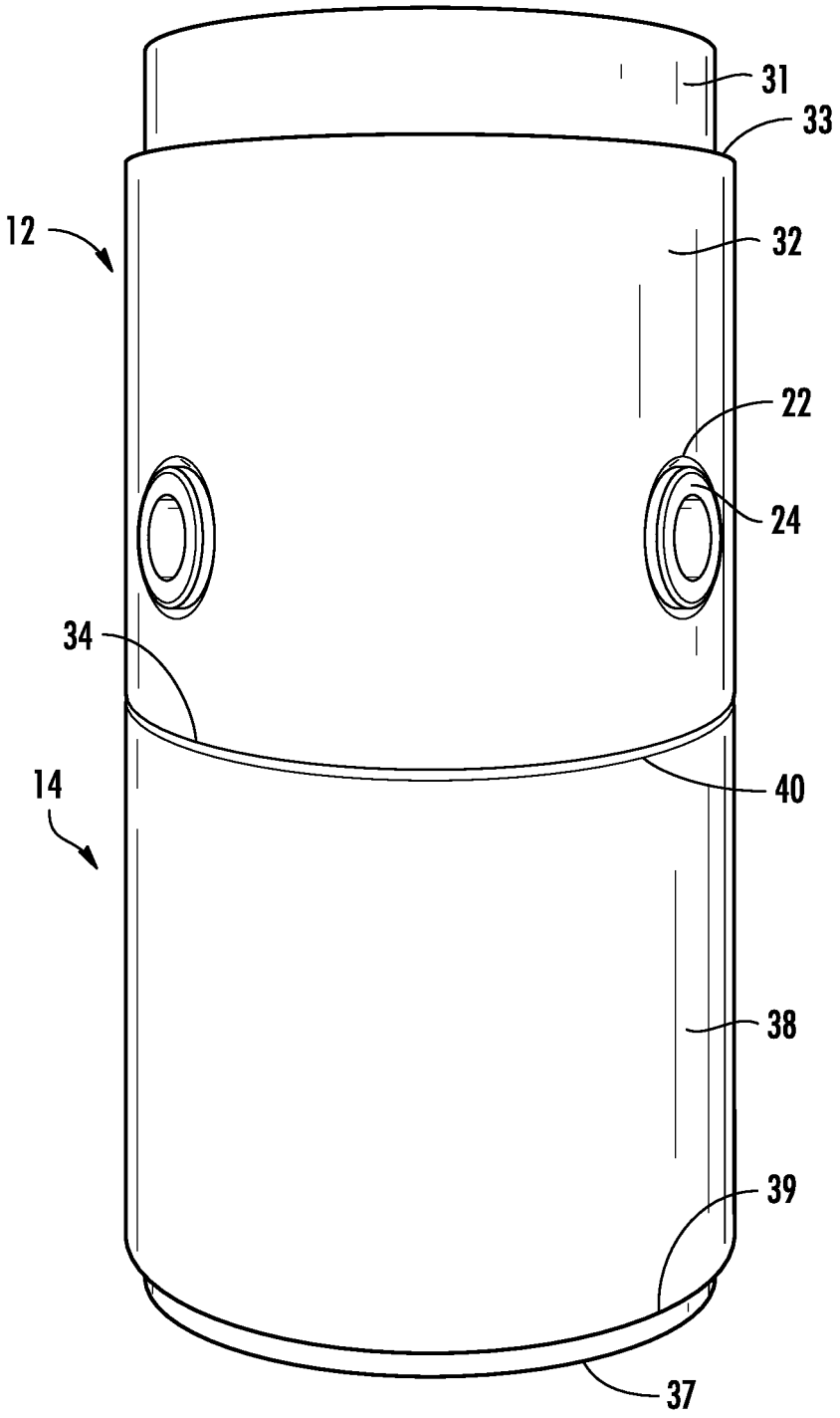
FIG. 6B is a side perspective view of a coupled female column coupling and male column coupling.

One or more embodiments further comprise one or more fasteners 24. Each one of the one or more fasteners 24 extends through a different one of the one or more holes 22 of the female column coupling 12 and into a different one of the one or more holes 42 of the male column coupling 14 to couple the female column coupling 2 to the male column coupling 14. FIGS. 3A, 4C, and 6B depict non-limiting embodiments of a female column coupling 12 coupled to a male column coupling 14.

As noted above, FIG. 2 depicts a non-limiting embodiment of a spiral staircase assembly 1 in three separate pieces after initial assembly and cutting, while FIG. 1 depicts the non-limiting embodiment of the spiral staircase assembly 1 of this disclosure after initial assembly, cutting, and reassembly. In one or more embodiments, a spiral staircase assembly 1 comprises two or more handrails 6*a*, 6*b*, 6*c* formed from a single handrail (as shall be described in greater detail below). In short, a plurality of balusters 8 may be coupled to the plurality of stairs 4 and a handrail 6 may be coupled to the plurality of balusters distal the plurality of stairs. Once the handrail 6 is coupled to the plurality of balusters 8 distal the plurality of stairs 4, the handrail 6 may be cut to form two or more handrails, such as but not limited to 6*a*, 6*b*, and 6*c*. The handrail 6 may be cut at one or more positions to match the cutting of the center column 2 and form two or more separate staircase assembly pieces each comprising a center column, a plurality of stairs, a plurality of balusters, and a handrail.

One or more embodiments of a staircase assembly 1 comprise a first handrail 6*a* coupled to a second handrail 6*b*. While reference is made below to coupling of the first handrail 6*a* to the second handrail 6*b*, it will be understood that the second handrail 6*b* may be similarly coupled to a third handrail 6*c*, a third handrail 6*c* may be similarly coupled to a fourth handrail, and so on. In some embodiments the first handrail 6*a* and the second handrail 6*b* are removably coupled together with a female handrail coupling 16 coupled directly to the first handrail 6*a* and a male handrail 18 directly coupled to the second handrail 6*b*. It will be understood that the female handrail coupling 16 and the male handrail coupling may be switched with one another without departing from the scope of this disclosure. FIG. 2 shows a non-limiting embodiment of a disassembled staircase assembly 1 with a first handrail 6*a* comprising a female handrail coupling 16 coupled thereto, a second handrail 6*b* comprising a male handrail coupling 18 configured and positioned to couple to the female handrail coupling 16 of the first handrail 6*a* and a female handrail coupling 16 coupled to the second handrail 6*b* distal the male handrail coupling 18 coupled thereto, and a third handrail 6*c* comprising male handrail coupling 18 configured and positioned to couple to the female handrail coupling 16 of the second handrail 6*b*.

According to some aspects, a male handrail coupling 18 and/or a female handrail coupling 16 may be fixedly couple to a respective handrails 6*a*, 6*b*, 6*c* with welding 20. For example, in the non-limiting embodiment shown in FIG. 3B, the male handrail coupling 18 is coupled to a first end of the second handrail 6*b* with welding 20, and the female handrail coupling 16 is coupled to a first end of the first handrail 6*a* with welding 20. In other embodiments, the male handrail coupling 18 and female handrail coupling 16 may be fixedly or removably coupled to the respective handrails with any fastener, adhesive, and the like known in the art.

Figure 5A:
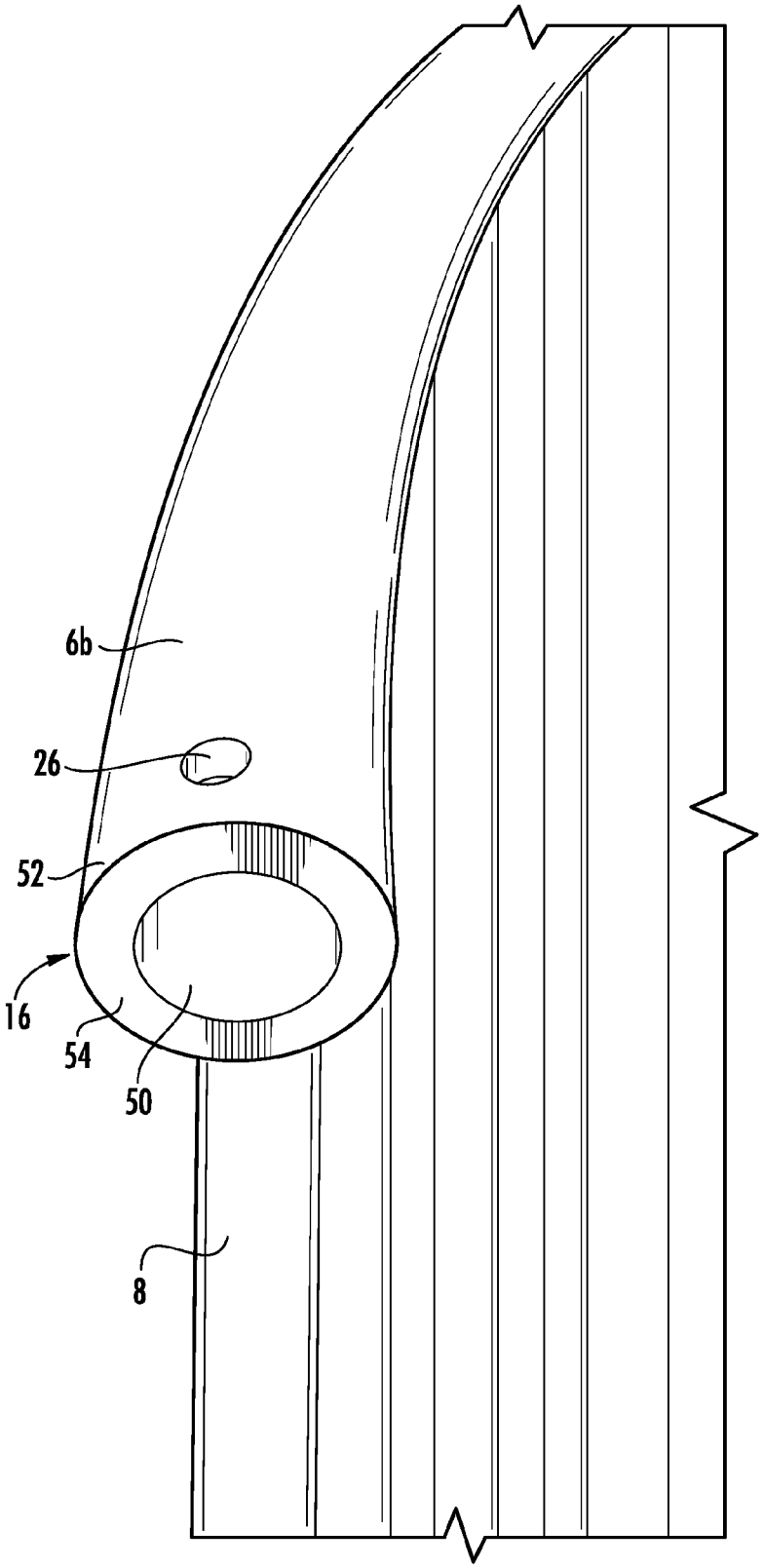
FIG. 5A is a close up view of a female handrail coupling coupled to a handrail.
Figure 7A:
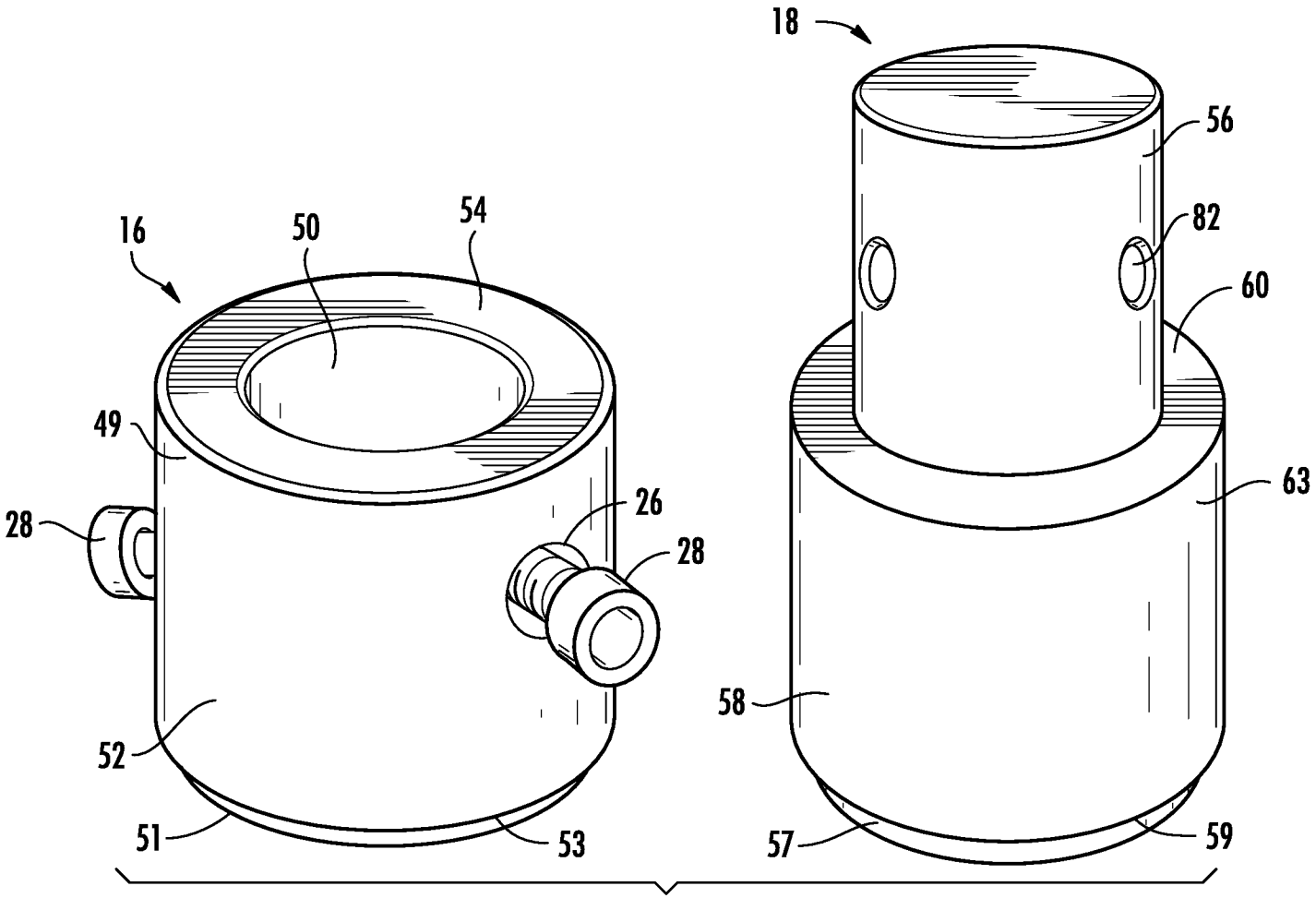
FIG. 7A is a side perspective view of an uncoupled female handrail coupling and male handrail coupling.

Reference is made herein to a female handrail coupling 16. A female handrail coupling 16 according to various embodiments may comprise any female coupling known in the art and configured to couple to a handrail and removably couple to a male coupling. FIG. 5A shows a non-limiting embodiment of a female handrail coupling 16 fixedly coupled to a second handrail 6*b* and FIG. 7A shows a non-limiting embodiment of a female handrail coupling 16 separated from a male handrail coupling 18. In one or more embodiments, a female handrail coupling 16 comprises a base 51 positioned within the first handrail 6*a* (or second handrail 6*b*, third handrail 6*c*, etc.), a body 52 positioned outside the second handrail 6*b*, a column lip 53 abutting a first end of the first handrail 6*a* (shown in FIG. 3B) and positioned between the base 51 and the body 52, a coupling end 53 opposite the base 51, a receiver 50 extending into the coupling end 54 and sized to receive the head 56 of the male handrail coupling 18, and one or more holes 26 extending through the body 52 to the receiver 50. In one or more embodiments, the body 52 may be sized such that the outer surface 49 of the body 52 is substantially flush with the outer surface of the first handrail 6*a*, the outer surface 63 of the male handrail coupling 18, and the outer surface of the second handrail 6*b*. In some embodiments, the receiver 50 may be sized to interface with the head 36 of the male column coupling 14 when the female column coupling 12 and the male column coupling 14 are coupled to one another.

Figure 5B:
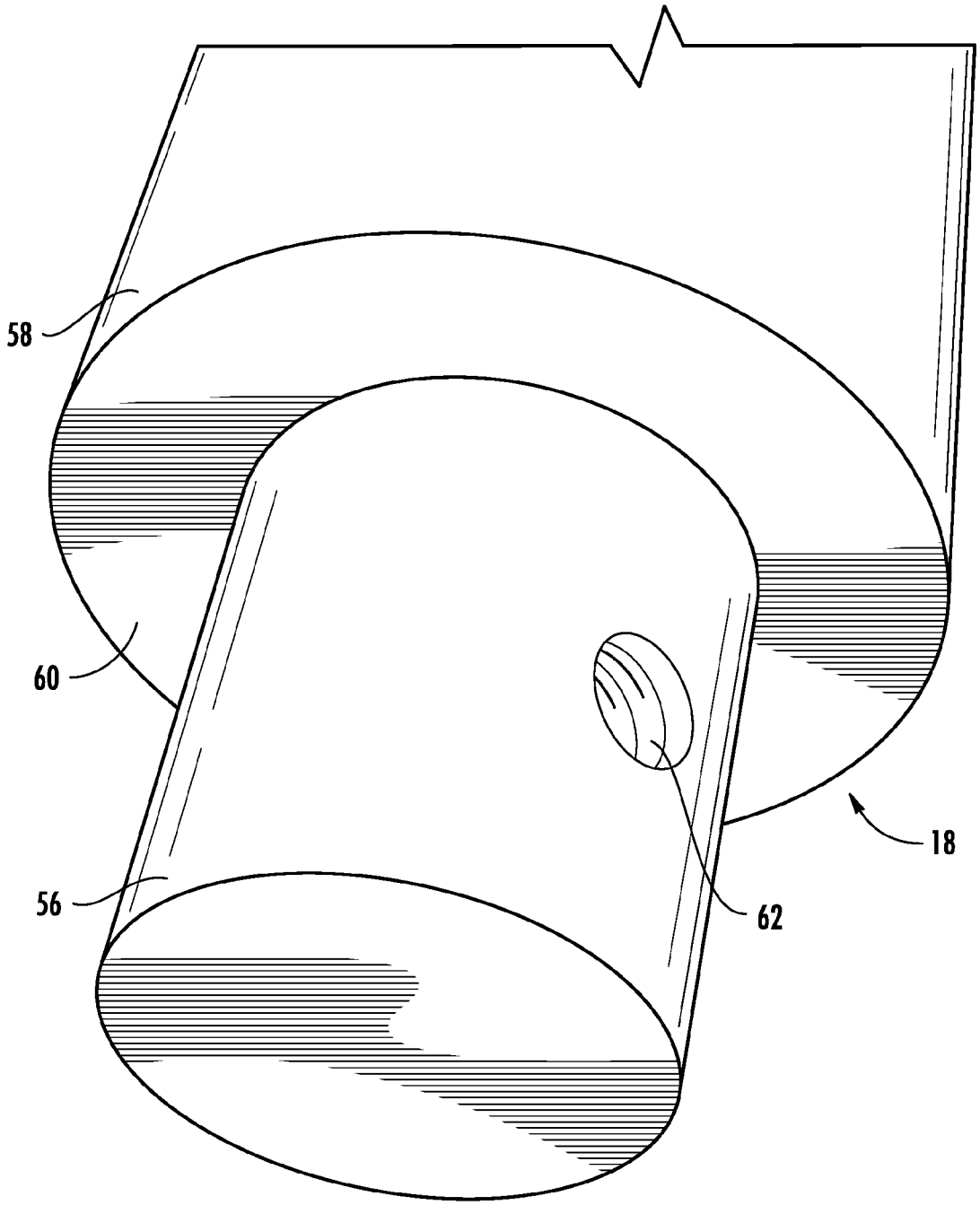
FIG. 5B is a close up view of a male handrail coupling coupled to a handrail.

Reference is made herein to a male handrail coupling 18. A male handrail coupling 18 according to various embodiments may comprise any male coupling known in the art and configured to couple to a handrail and removably couple to a female coupling. FIG. 5B shows a non-liming embodiment of a male handrail coupling 18 fixedly coupled to a first handrail 6*a* and FIG. 7A shows a non-limiting embodiment of a male handrail coupling 18 separated from a female handrail coupling 16. In one or more embodiments, a male handrail coupling 18 comprises a base 57 positioned within the second handrail 6*b* (or first handrail 6*a*, third handrail 6*c*, etc.), a body 58 positioned outside the second handrail 6*b*, a column lip 59 abutting a first end of the second handrail 6*b* (shown in FIG. 3B) and positioned between the base 57 and the body 58, a head 56 positioned within the receiver 50 of the female handrail coupling 16, a coupling lip 60 positioned between the head 56 and the body 58 and abutting the coupling end 54 of the female handrail coupling 16, and one or more holes 82 extending into the head 56. The one or more holes 82 extended into the head 56 of the male handrail coupling 18 are positioned to align with the one or more holes 26 extending through the body 52 of the female handrail coupling 16. In one or more embodiments, the body 58 may be sized such that the outer surface 63 of the body 58 is substantially flush with the outer surface of the first center column, the outer surface 49 of the female handrail coupling 16, and the outer surface of the second handrail 6*b* (see, for example, FIG. 3B). In some embodiments, the head 56 may be sized to interface with the receiver 50 of the female handrail coupling 16 when the female handrail coupling 16 and the male handrail coupling 18 are coupled to one another.

Figure 3B:
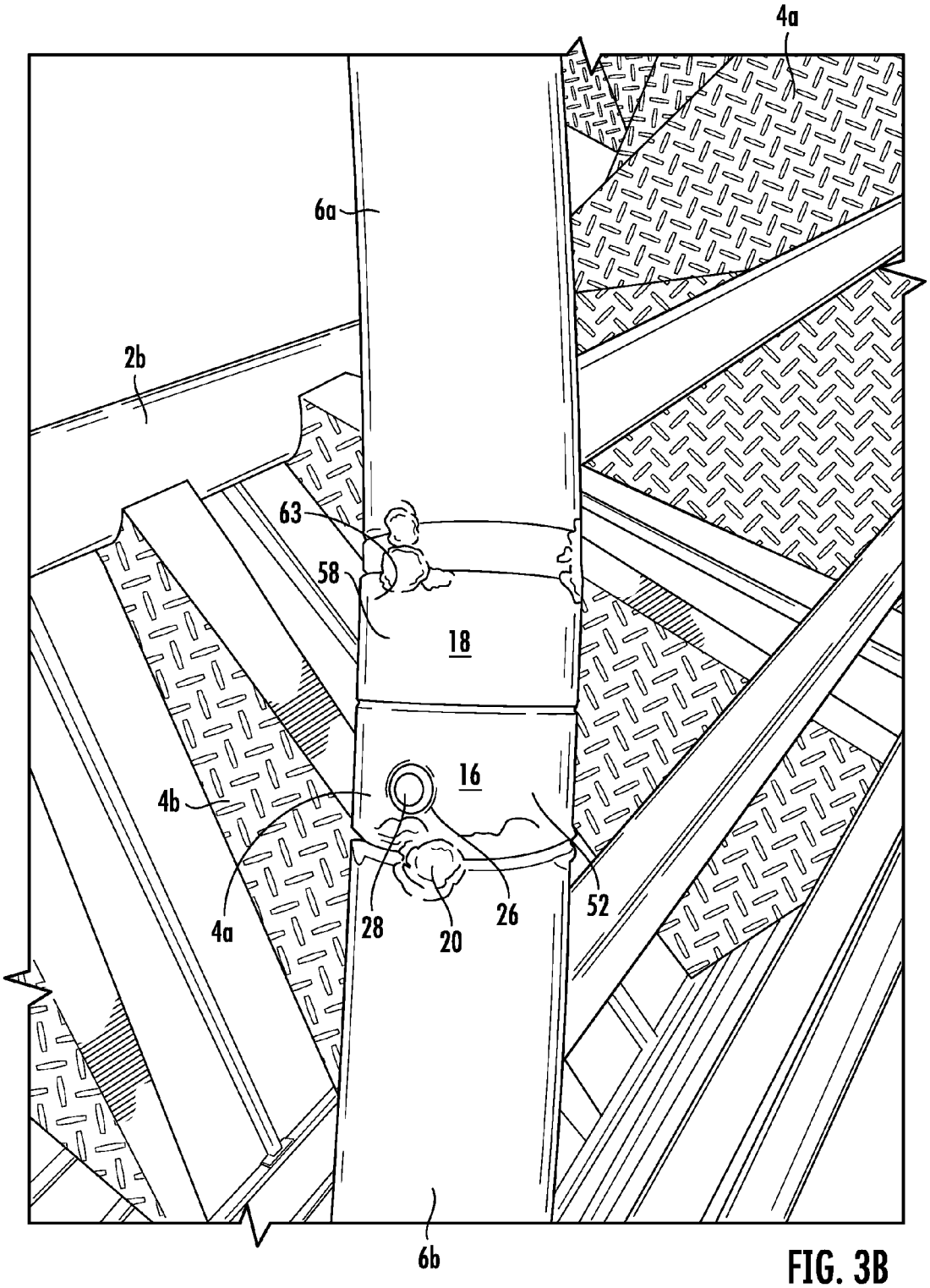
FIG. 3B is a close up view of a male handrail coupling and a female handrail coupling a first handrail and a second handrail of a spiral staircase assembly.
Figure 7B:
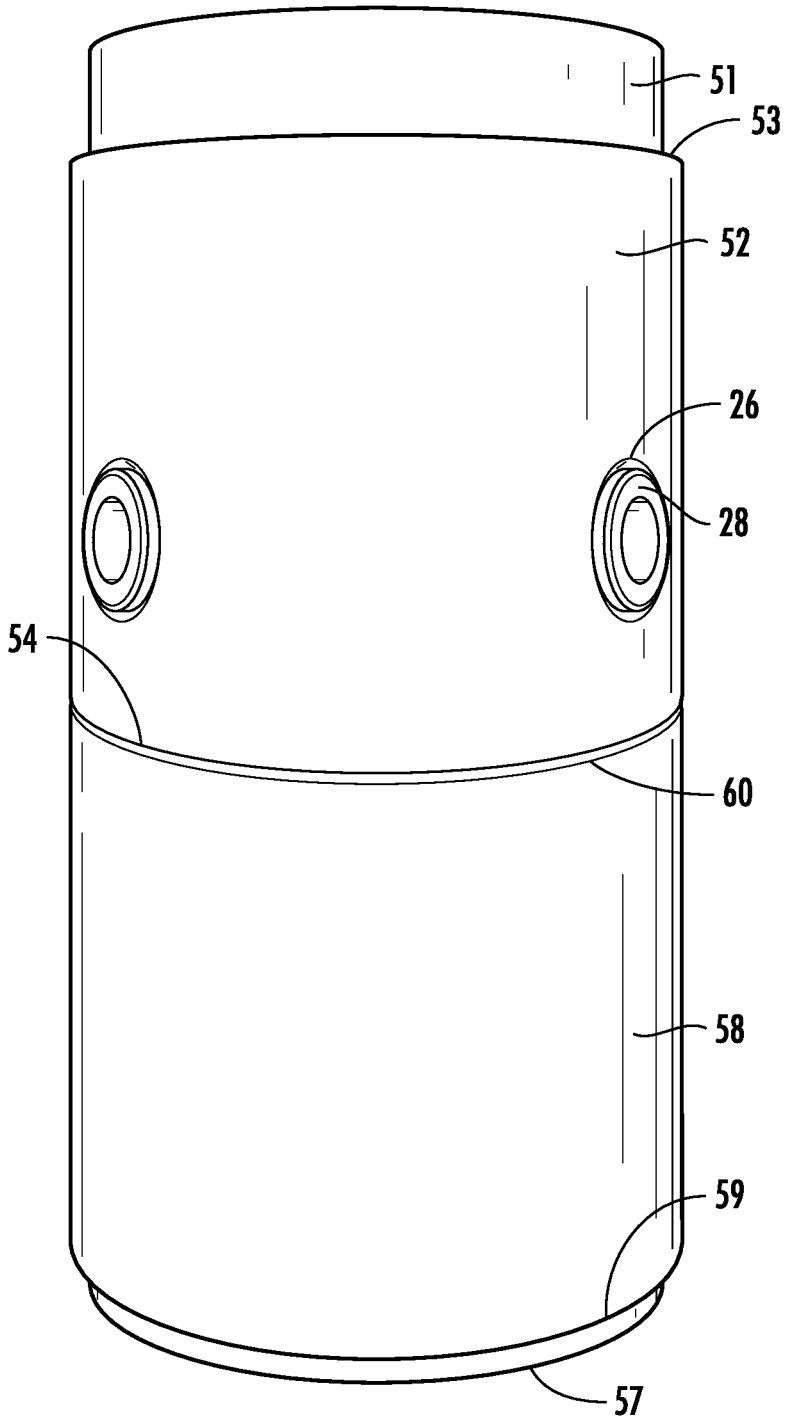
FIG. 7B is a side perspective view of a coupled female handrail coupling and male handrail coupling.

One or more embodiments further comprise one or more fasteners 28. Each one of the one or more fasteners 28 extends through a different one of the one or more holes 26 of the female handrail coupling 16 and into a different one of the one or more holes 82 of the male column coupling 18 to couple the female handrail coupling 16 to the male handrail coupling 18. FIGS. 3B and 7B depict non-limiting embodiments of a female handrail coupling 16 coupled to a male handrail coupling 18.

Also contemplated herein is a method of manufacturing a spiral staircase assembly 1. In one or more embodiments, a method may comprise coupling a plurality of stairs 4 to a center column 2 such that distances between adjacent stairs of the plurality of stairs 4 deviates less than ½". In more particular embodiments, respective distances 61 between top surfaces of adjacent stairs of the plurality of stairs 4 may deviate less than approximately ⅜". Various national and local building codes may require a substantially uniform distance between top surfaces of stairs on a staircase. For example, a national or local building code may require less than ½" or ⅜" deviation in the distances 61 between top surfaces of adjacent steps on the staircase.

A method of manufacturing a spiral staircase assembly 1 may further comprise cutting the center column 2 between a first stair of the plurality of stairs 4 and a second stair of the plurality of stairs 4 adjacent the first stair after coupling the plurality of stairs 4 to the center column to form a first center column 4*a* and a second center column 4*b*. Cutting the center column 2 to form the first center column 2*a* and the second column 2*b* may comprise cutting a portion from the center column 2 to form the first center column 2*a* and the second center column 2*b*, the portion cut from the center column 2 comprising a height substantially equal to a combined height of the body 32 of the female column coupling 12 and the body 38 of the male column coupling 14. Cutting the center column 2 may be done with any cutting device known in the art. It is further contemplated that a method may comprise cutting the center column 2 between adjacent stairs of the plurality of stairs 4 to form a third center column 2*c*, a fourth center column, and so on.

Furthermore, it is contemplated that while reference is made below to a first center column 2*a* and a second center column 2*b*, steps may be similarly or identically applied to second center columns 2*b* and third center column 2*c*, third center columns 2*c* and fourth center columns, and so on. A method may further comprise inserting a base 31 of a female column coupling 12 into the first end 3*a* of the first center column 2*a* until a column lip 33 of the female column coupling 12 abuts the first end 3*a* of the first center column 2*a* and before welding the female column coupling 12 to the first end 3*a* of the first center column 2*a* such that a body 32 of the female column coupling 12 is positioned outside the first center column 2*a*.

A method of manufacturing a spiral staircase assembly 1 may further comprise inserting a base 37 of a male column coupling 14 into a first end 3*b* of the second center column 2*b* until a column lip 39 of the male column coupling 14 abuts the first end 3*b* of the second center column 2*b* before welding the male column coupling 14 to the first end 3*b* of the second center column 2*b* such that a body 38 of the male column coupling 14 is positioned outside the second center column 2*b*. The male column coupling 14 may be configured to couple to the female column coupling 12 such that when the male column coupling 14 is coupled to the female column coupling 12, distances 61 between adjacent stairs of the plurality of stairs deviates less than ½" or less than ⅜".

A method of manufacturing a spiral staircase assembly 1 may further comprise coupling the female column coupling 12 to the male column coupling 14 after welding the female column coupling 14 to the first center column 2*a* and welding the male column coupling 14 to the second center column 2*b*. Coupling the female column coupling 12 to the male coupling 14 may comprise inserting a head 36 of the male column coupling 14 distal the base 37 of the male column coupling 14 into a receiver 30 of the female column coupling 12 distal the base 31 of the female column coupling 14. Coupling the female column coupling 12 to the male column coupling 14 may further comprise inserting at least one fastener 24 through a hole 22 in the female column coupling 12 aligned with a hole 42 in the head 36 of the male column coupling 14.

A method of manufacturing a spiral staircase assembly 1 may further comprise coupling a plurality of balusters 8 to the plurality of stairs 4 before cutting the center column 2. A method of manufacturing a spiral staircase assembly 1 may further comprise coupling a handrail 6 to the plurality of balusters 8 distal the plurality of stairs 4 before cutting the center column 2, cutting the handrail 6 between the two adjacent stairs of the plurality of stairs 4 to form a first handrail 6*a* and a second handrail 6*b*. Cutting the handrail 6 to form the first handrail 6*a* and the second handrail 6*b* may comprise cutting a portion from the handrail 6 to form the first handrail 6*a* and the second handrail 6*b*, the portion cut from the handrail 6 comprising a dimension substantially equal to a combined dimension of the body 52 of the female handrail coupling 16 and the body 58 of the male handrail coupling 14. Cutting the handrail 6 may be done with any cutting device known in the art. It is further contemplated that a method may comprise cutting the handrail 6 between adjacent stairs of the plurality of stairs 4 to form a third handrail 6*c*, a fourth handrail, and so on.

Furthermore, it is contemplated that while reference is made below to a first handrail 6*a* and a second handrail 6*b*, steps may be similarly or identically applied to a second handrail 6*b* and a third handrail 6*c*, third handrail 6*c* and fourth handrail, and so on. A method of manufacturing a spiral staircase assembly 1 may further comprise welding a female handrail coupling 16 to a first end of the first handrail 6*a* and welding a male handrail coupling 18 to a first end of the second handrail 6*b*, the male handrail coupling 18 configured to couple to the female handrail coupling 16.

A method of manufacturing a spiral staircase assembly 1 may further comprise coupling the female handrail coupling 16 to the male handrail coupling 18 and coupling the female handrail coupling 16 to the male handrail coupling 18. Coupling the female handrail coupling 16 to the male handrail coupling 18 may comprise inserting a head 56 of the male handrail coupling 18 distal the base 57 of the male handrail coupling 18 into a receiver 50 of the female handrail coupling 16 distal the base 51 of the female handrail coupling 16. Coupling the female handrail coupling 16 to the male column coupling 18 may further comprise inserting at least one fastener 28 through a hole 26 in the female handrail coupling 16 aligned with a hole 82 in the head 56 of the male handrail coupling 18.

Also contemplated herein is a method of manufacturing a custom spiral staircase assembly 1. In one or more embodiments, a method of manufacturing a custom spiral staircase assembly 1 may comprise determining a custom height 62 at an installation site for a spiral staircase assembly 1, determining a number of individual stairs of a plurality of stairs 6 to position within the custom height of the spiral staircase assembly 1, and determining a distance 61 between adjacent stairs of the plurality of stairs 6 such that distances 61 between adjacent stairs of the plurality of stairs 6 deviates less than ½" or more particularly ⅜". As noted above, various national and local building codes may require a substantially uniform distance between stairs on a staircase. Thus, spiral staircases must often be made for specific or custom jobs such that less than ½" or ⅜" deviation in the distances between adjacent steps on the staircase. Conventional systems and methods typically require welding or otherwise coupling the plurality of stairs to the center column of the staircase on site after determining the proper height dimension and spacing of the steps to meet the code.

In contrast, a method of manufacturing a custom spiral staircase assembly 1 as contemplated herein may comprise coupling the plurality of stairs 6 to a center column 2 at the place of manufacture such that distances between adjacent stairs of the plurality of stairs 6 deviates less than ½", and then cutting the center column 2, at the place of manufacture, between a first stair of the plurality of stairs 6 and a second stair of the plurality of stairs 6 adjacent the first stair after coupling the plurality of stairs 6 to the center column 2 to form a first center column 2*a* and a second center column 2*b*. By welding the plurality of stairs 6 to the center column 2 and cutting the center column 2 at the place of manufacture, a manufacturer is able to custom size/fit the spiral staircase assembly 1 for a particular job at the place of manufacture to meet the necessary code rather than the installation site, then break the spiral staircase assembly 1 down for easier transportation to the desired location. The manufacturer may further modify the spiral stair case assembly 1 for simply and efficient reconstruction at the installation site, as shall be described in greater detail below.

In some embodiments, a method of manufacturing a custom spiral staircase assembly 1 as contemplated herein may comprise welding or otherwise coupling a female column coupling 12 to a first end 3*a* of the first center column 2*a*, welding or otherwise coupling a male column coupling 14 to a first end 3*b* of the second center column 2*b*, the male column coupling 14 configured to couple to the female column coupling 12 such that when the male column coupling 14 is coupled to the female column coupling 12, distances between adjacent stairs of the plurality of stairs deviates less than ½" or, more particularly, less than ⅜". A method may further comprise inserting a base 31 of the female column coupling 12 into the first end 3*a* of the first center column 2*a* until a column lip 33 of the female column coupling 12 abuts the first end 3*a* of the first center column 2*a* before welding the female column coupling 12 to the first end 3*a* of the first center column 2*a* such that a body 32 of the female column coupling 12 is positioned outside the first center column 2*a*, and inserting a base 37 of the male column coupling 14 into the first end 3*b* of the second center column 2*b* until a column lip 39 of the male column coupling 14 abuts the first end 3*b* of the second center column 2*b* before welding the male column coupling 14 to the first end 3*b* of the second center column 2*b* such that a body 38 of the male column coupling 14 is positioned outside the second center column 2*b*.

A method of manufacturing a custom spiral staircase assembly 1 as contemplated herein may comprise transporting the first center column 2*a*, with the first plurality of stairs 4*a* coupled to the first center column 2*a*, and the second center column 2*b*, with the second plurality of stairs 4*b* coupled to the second center column 2*b*, to the installation site. A method may further comprise coupling the first center column 2*a* to the second center column 2*b* at the installation site. Coupling first center column 2*a* to the second center column 2*b* at the installation site may comprise inserting a head 36 of the male column coupling 14 distal the base 37 of the male column coupling 14 into a receiver 30 of the female column coupling 12 distal the base 31 of the female column coupling 12. A method may further comprise inserting at least one fastener 24 through a hole 22 in the female column coupling 12 aligned with a hole 42 in the head 36 of the male column coupling 12 to couple the female column coupling 14 to the male coupling 12.

A method of manufacturing a custom spiral staircase assembly 1 as contemplated herein may comprise coupling a plurality of a balusters 8 to the plurality of stairs 4 before cutting the center column 2, coupling a handrail 6 to the plurality of balusters 8 distal the plurality of stairs 4 before cutting the center column 2, and/or cutting the handrail 8 between the two adjacent stairs of the plurality of stairs 4 to form a first handrail 8*a* and a second handrail 8*b*. A method may further comprise welding or otherwise coupling a female handrail coupling 16 to a first end of the first handrail 8*a* and welding or otherwise coupling a male handrail coupling 18 to a first end of the second handrail 8*b*, the male handrail coupling 18 configured to couple to the female handrail coupling 16. A method may further comprise coupling the female handrail coupling 16 to the male handrail coupling 18. Coupling the female handrail coupling 16 to the mail handrail coupling 18 may comprise inserting a head 56 of the male handrail 18 coupling distal a base 57 of the male handrail coupling 18 into a receiver 50 of the female handrail coupling 16 distal a base 51 of the female handrail coupling 16, and inserting at least one fastener 28 through a hole 26 in the female handrail coupling 16 aligned with a hole 82 in the head 56 of the male handrail coupling 18 to couple the female handrail coupling 16 to the male handrail coupling 18.

It will be understood that implementations are not limited to the specific components disclosed herein, as virtually any components consistent with the intended operation of a method and/or system implementation for a spiral staircase assembly may be utilized. Accordingly, for example, although particular spiral staircase assemblies may be disclosed, such components may comprise any shape, size, style, type, model, version, class, grade, measurement, concentration, material, weight, quantity, and/or the like consistent with the intended operation of a method and/or system implementation for a spiral staircase assembly may be used.

In places where the description above refers to particular implementations of a spiral staircase assembly, it should be readily apparent that a number of modifications may be made without departing from the spirit thereof and that these implementations may be applied to other spiral staircase assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A method of manufacturing a spiral staircase assembly, the method comprising:

affixing a plurality of stairs to a center column, the plurality of stairs comprising, among others, a first stair and a second stair adjacent to the first stair;

cutting the center column between the first stair and the second stair after affixing the plurality of stairs to the center column, wherein cutting the center column divides the center column into a first center column and a second center column; and welding a male column coupling to a first end of the second center column after cutting the center column that has the second stair affixed, the male column coupling sized and shaped to mate with a first end of the first center column such that when the male column coupling is mated with the first end of the first center column coupling each stair of the plurality of stairs has at least one distance between a top surface of the stair and a top surface of at least one adjacent stair, the distances between the top surface of each stair and the top surface of each adjacent stair is within a ½" deviation of all other distances between the top surfaces of the adjacent stairs.

2. The method of claim 1, further comprising:

after cutting the center column that has the plurality of stairs affixed, inserting a base of a female column coupling into the first end of the first center column until a column lip of the female column coupling abuts the first end of the first center column before welding the female column coupling to the first end of the first center column such that a body of the female column coupling is positioned outside the first center column; and inserting a base of the male column coupling into the first end of the second center column until a column lip of the male column coupling abuts the first end of the second center column before the welding of the male column coupling to the first end of the second center column such that a body of the male column coupling is positioned outside the second center column.

3. The method of claim 2, wherein cutting the center column to form the first center column and the second column comprises cutting a portion from the center column to form the first center column and the second center column, the portion cut from the center column comprising a height substantially equal to a combined height of the body of the female column coupling mated with the body of the male column coupling.

4. The method of claim 2, further comprising coupling the female column coupling to the male column coupling after welding the female column coupling to the first center column and after welding the male column coupling to the second center column.

5. The method of claim 4, wherein coupling the female column coupling to the male coupling comprises:

inserting a head of the male column coupling distal the base of the male column coupling into a receiver of the female column coupling distal the base of the female column coupling; and inserting at least one fastener through a hole in the female column coupling aligned with a hole in the head of the male column coupling.

6. The method of claim 1, further comprising:

coupling a plurality of balusters to the plurality of stairs before cutting the center column;

coupling a handrail to the plurality of balusters distal the plurality of stairs before cutting the center column;

cutting the handrail between the two adjacent stairs of the plurality of stairs to form a first handrail and a second handrail;

welding a female handrail coupling to a first end of the first handrail; and welding a male handrail coupling to a first end of the second handrail, the male handrail coupling configured to couple to the female handrail coupling.

7. The method of claim 6, further comprising coupling the female handrail coupling to the male handrail coupling.

8. A method of manufacturing a custom spiral staircase assembly, the method comprising:

determining a custom spiral staircase height at an installation site for a spiral staircase assembly;

determining a number of individual stairs of a plurality of stairs to position within the custom height of the spiral staircase assembly;

determining a distance between top surfaces of adjacent stairs of the plurality of stairs such that each stair of the plurality of stairs has at least one distance between the top surface of the stair and the top surface of at least one adjacent stair and the distances between the top surface of each stair and the top surface of each adjacent stair is within a ½" deviation of all other distances between the top surfaces of adjacent stairs;

affixing the plurality of stairs to a center column, the plurality of stairs comprising, among others, a first stair and a second stair adjacent to the first stair; and cutting the center column between the first stair and the second stair after affixing the plurality of stairs to the center column to form a first center column with a first plurality of stairs of the plurality of stairs including the first stair affixed thereto, and a second center column with a second plurality of stairs of the plurality of stairs including the second stair affixed thereto.

9. The method of claim 8, further comprising:

inserting a base of a female column coupling into a first end of the first center column until a column lip of the female column coupling abuts the first end of the first center column and a body of the female column coupling is positioned outside the first center column;

welding the female column coupling to a first end of the first center column;

inserting a base of a male column coupling into the first end of the second center column until a column lip of the male column coupling abuts the first end of the second center column and a body of the male column coupling is positioned outside the second center column; and welding the male column coupling to a first end of the second center column, the male column coupling configured to couple to the female column coupling such that when the male column coupling is coupled to the female column coupling, the distances between each stair and each adjacent stair is within a ½" deviation of all other distances between adjacent stairs.

10. The method of claim 9, further comprising:

transporting the first center column, with the first plurality of stairs coupled to the first center column, and the second center column, with the second plurality of stairs coupled to the second center column, to the installation site; and coupling the first center column to the second center column at the installation site by joining the male column coupling to the female column coupling.

11. The method of claim 10, wherein coupling first center column to the second center column at the installation site comprises:

inserting a head of the male column coupling distal the base of the male column coupling into a receiver of the female column coupling distal the base of the female column coupling; and inserting at least one fastener through a hole in the female column coupling aligned with a hole in the head of the male column coupling to couple the female column coupling to the male coupling.

12. The method of claim 8, further comprising:

coupling a plurality of a balusters to the plurality of stairs before cutting the center column;

coupling a handrail to the plurality of balusters distal the plurality of stairs before cutting the center column; and cutting the handrail between the two adjacent stairs of the plurality of stairs to form a first handrail and a second handrail.

13. The method of claim 12, further comprising welding a female handrail coupling to a first end of the first handrail;

welding a male handrail coupling to a first end of the second handrail, the male handrail coupling configured to couple to the female handrail coupling.

14. The method of claim 13, further comprising coupling the female handrail coupling to the male handrail coupling by:

inserting a head of the male handrail coupling distal a base of the male handrail coupling into a receiver of the female handrail coupling distal a base of the female handrail coupling; and inserting at least one fastener through a hole in the female handrail coupling aligned with a hole in the head of the male handrail coupling to couple the female handrail coupling to the male handrail coupling.

* * * * *